US005406301A

United States Patent [19]

Ravid

[11] Patent Number: 5,406,301

[45] Date of Patent: Apr. 11, 1995

[54] HIGH RELIABILITY DISPLAY

[75] Inventor: Arie Ravid, Palo Alto, Calif.

[73] Assignee: Abbott Laboratories, Abbott Park, Ill.

[21] Appl. No.: 143,871

[22] Filed: Oct. 27, 1993

[51] Int. Cl.[6] ..... G09G 3/04

[52] U.S. Cl. ..... 345/34; 345/93; 345/904; 340/825.01

[58] Field of Search ..... 345/34, 93, 904; 340/825.01, 825.02–825.04

[56] References Cited

U.S. PATENT DOCUMENTS 4,380,371 4/1983 Franz ..... 345/34
4,807,973 2/1989 Kawasaki ..... 345/93
4,820,222 4/1989 Holmberg et al. ..... 345/93
5,214,417 5/1993 Yamazaki ..... 345/93

*Primary Examiner*—Ulysses Weldon
*Assistant Examiner*—Amare Mengistu
*Attorney, Agent, or Firm*—Harry G. Thibault; Thomas M. Breininger

[57] ABSTRACT

A character display in which failures are evident. Selected segments of a seven-segment LCD are activated by control signals supplied through selected fore plane and back plane traces. By coupling specific ones of the fore plane and back plane control signals to selected segments, any failure in the control signal or circuitry providing the signal to the segments of the display character becomes immediately evident to an operator when the character represented by the display is not one of a predefined set of characters.

20 Claims, 4 Drawing Sheets

3/4

58a
58b
58c
58d
58e
58f
58g
74
BP1
76
BP2
BP3
BP4
80
82
78
84
86
74'
BP1
76'
78'
BP2
BP3
BP4
80'
54b
TO NEXT CHARACTER 56a
56b
56c
56d
56e
56f
56g
60
FP1
64
66
68
62
72
70
FP2
54a

HIGH RELIABILITY DISPLAY

FIELD OF THE INVENTION

This invention generally relates to a digital display, and more specifically, to a display that includes a plurality of segments, which are selectively energized to indicate a specific alphanumeric character.

BACKGROUND OF THE INVENTION

In a conventional alphanumeric display, individual segments arranged in some predefined pattern are selectively energized to visually represent a desired character. The most common type of display includes at least seven discrete segments arranged so as to visually represent a numeral eight if all of the segments are simultaneously energized. Although this type of display can represent a limited number of alpha characters, it is most often employed to represent the numbers zero through nine. Substantially the same seven segment configuration (although fabricated very differently for the two types of display technologies) can be used for both light emitting diode (LED) displays and liquid crystal displays (LCDs).

There are several advantages that justify using LCDs rather than LEDs in instrument display panels. Particularly important in portable, battery powered instruments is the intrinsically lower power requirement of the liquid crystal technology. In addition, relatively complex arrangements of graphic icons and alphanumeric character displays can readily be configured on a common substrate to produce a complete LCD panel for an instrument. By contrast, LED displays are more directed to representing characters than graphic icons and are not as easily fabricated in complex, integrated panels.

Each segment of an LCD corresponds to similarly shaped electrically conductive regions applied to the front and rear surfaces of the display. These electrically conductive regions are coupled to a control circuit that supplies a voltage appropriate to modify the optical characteristics of a liquid crystal layer disposed between the front and rear surfaces. The electrical signal applied to these regions causes the liquid crystal layer to become more opaque, so that a character or graphic icon corresponding to the shape of the electrically conducting regions is visible. Optionally, background lighting can be provided for an LCD to produce greater contrast so that the characters or icons are more easily visible at low ambient light levels.

There are certain applications in which a failure of one of the segments that defines a character or graphic icon may have life-threatening consequences. For example, a display panel on a medical instrument may indicate certain critical operating parameters to an operator of the instrument. Clearly, in this instance, it is very important to avoid errors in reading the displayed data. An error caused by the failure of a segment in a numeric display character would be particularly serious if the character is the most significant digit of a critical displayed value. For instance, failure of the center segment in a seven segment character of the display would cause an "8" to visually appear as an "0". A medical practitioner relying on the incorrect displayed reading caused by such a failure might use the instrument in a manner that hams a patient. Accordingly, for any critical displayed parameter on a medical instrument or on instruments used in other critical applications, designers have recognized the importance of detecting a display failure so that the user is alerted and does not rely upon an incorrect value.

One way to insure that a failure in a critical display character is detected is to duplicate the entire displayed parameter, so that two nominally identical values for the parameter are indicated in separate displays. If the two displayed values are different, the user is supposed to recognize that a failure has occurred in one of the duplicated displays. However, because the two displayed values are spatially separate, such difference may go unnoticed. Moreover, space limitations on a display panel often render it impractical to provide duplicate values of a parameter, and this solution to the problem is inelegant at best.

If LEDs are used for such critical displayed parameters, the electrical current to each digit of the display can be monitored and compared to an expected value in a look-up table that relates each of the possible characters to the electrical current draw required for that character, based on the number of segments that must be selectively energized to represent it. For example, a numeral "1" requires that only two segments be energized (in a seven segment display), and the look-up table defines a current corresponding to that required by the two segments. If less current is detected, at least one of the two segments may have failed and a monitoring circuit alerts the operator with a visual and/or audible alarm. Similarly, if current to a segment is detected when that segment should not be energized, the monitoring circuit also detects a failure.

Unfortunately, the low current requirements of LCDs make it practically impossible to detect a failed segment in an LCD character based on electrical current measurements. Consequently, although LCDs are almost uniformly preferred for display panels because of the variety of graphic options that can be included and because of their low power requirement, LEDs are often used for the display of critical parameter values, simply to ensure that the failure of a segment in the critical display can be detected by the current monitoring method. Therefore, both an LCD display panel and LEDs must be used on such instruments. It should be evident that it would be preferable to use only LCDs in a display panel, if failure of a segment of any LCD characters was clearly evident.

In a copending, commonly assigned patent application, Ser. No. 08/125,508, filed on Sep. 21, 1993, entitled "Display Having Redundant Segments" (R. Poli and A. Ravid), a solution to the above-noted problem is disclosed. In the invention disclosed in this reference, at least some of the segments comprising each display character are configured as pairs of segments, wherein one of the pair of segments is redundant, extending either parallel or end-to-end relative to the other segment of the pair. If one of the pair of segments should fail to be visually perceptible when activated or by remaining visually perceptible when de-activated, the failure will be immediately visually evident to the user because the other segment of the pair will continue to operate properly. Any difference between the operation of the two segments comprising each pair is visually evident and thus serves to warn a user that a problem or failure in the display has occurred. If fewer than all of the segments are formed as pairs of segments, the segments selected for redundant configuration are those in which failure of the segment, if not evident, could cause the resulting character to visually represent an incorrect character that might not otherwise be evident as an incorrect character.

Although the display circuit comprising the above-noted invention represents a solution to the problem of detecting failed segments in a display and yet representing a desired character even when a failure of one segment has occurred, there are some applications in which it may be too expensive to fabricate pairs of redundant segments, or in which the display panel does not have sufficient area or edge connect terminations to support the greater number of conducting traces and terminals required for such a display circuit. Accordingly, another approach that is simpler to fabricate and requires fewer conductors would be preferable.

SUMMARY OF THE INVENTION

In accordance with the present invention, a display circuit is defined that comprises a plurality of conducting traces. A plurality of segments are electrically coupled to the plurality of conducting traces and are configured in a predefined pattern on the substrate. The pattern is capable of visually representing a character from a set of predefined characters. Specific segments are electrically coupled to selected ones of the plurality of conducting traces. The conducting traces that are thus coupled to specific segments are selected so that a failure of any one of the conducting traces to electrically actuate a single segment to which it is electrically coupled, in response to an externally supplied electrical signal that should have actuated the segment, does not cause a different character of the set of predefined characters to be visually represented by the display circuit than would have been if the failure had not occurred. Thus, any failure that causes a non-recognized character (not from the set) serves to warn a user that this type of failure has occurred.

The display circuit also includes display control means that respond to the externally supplied electrical signal to provide an actuating voltage to specific segments that must be actuated to visually represent a selected character.

A fore plane electrode and a back plane electrode preferably define a visually perceived shape of each segment. The actuating voltage applied between the fore plane and back plane electrodes activates a liquid crystal region that is disposed between the fore plane electrode and the back plane electrode to change an optical property of the liquid crystal region so that the segment is visually perceptible, unless a failure has occurred.

The plurality of conducting traces comprise a set of fore plane traces and a set of back plane traces. The actuating voltage applied to activate the liquid crystal region for each segment is coupled to the fore plane electrode for that segment through one of the fore plane traces and to the back plane electrode for that segment through one of the back plane traces.

In one preferred form of the invention, one of the sets of the fore plane traces comprises two conducting traces, and the other set comprises four conducting traces. In addition, the set of predefined characters preferably includes at least the numbers zero through nine. It is further intended in at least some embodiments, that the substrate includes areas in which a plurality of characters are defined and are visually perceptible when selected segments are actuated.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
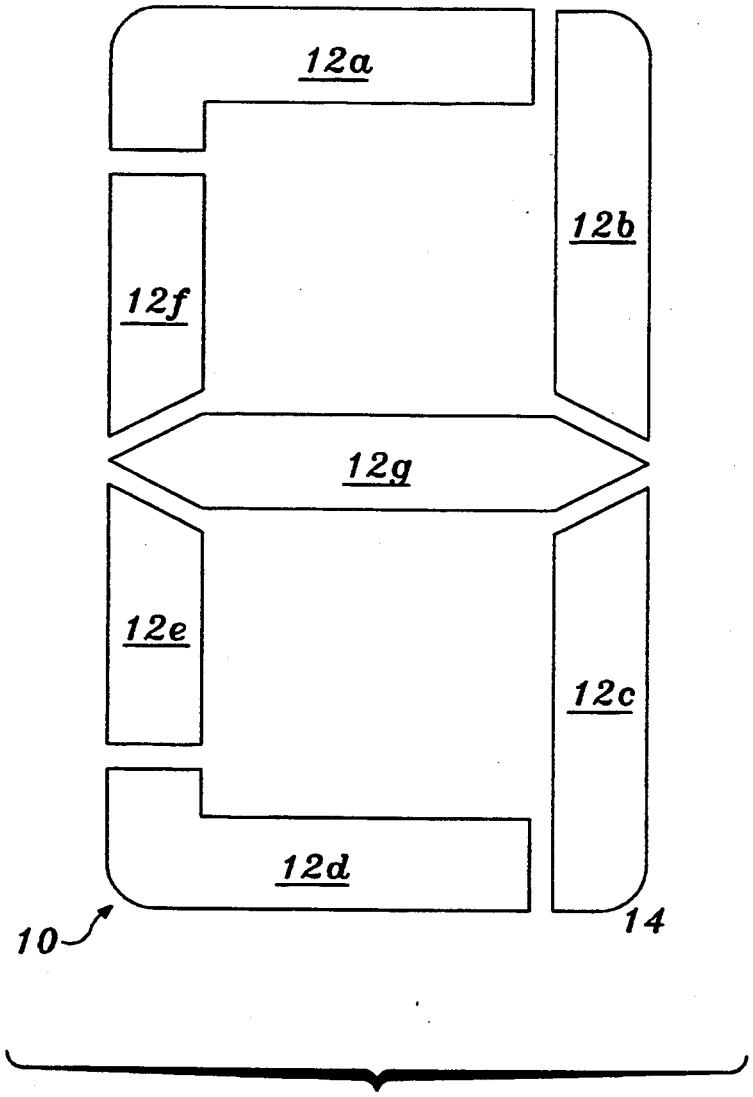
Fig. 1. PRIOR ART
FIG. 1 is an enlarged plan view of the segments in a prior art seven-segment LCD character.

FIG. 1 illustrates a generally conventional seven-segment LCD display character 10. Display character 10 includes segments **12*a*–12*g* configured so that when all of the segments are actuated, a numeral "8" is visually indicated. By controlling the specific segments 12*a*–12*g* that are activated, each of the numerals 0 through 9 can be selectively represented by display character 10. Alternatively, many of the alpha characters, such as A, C, E, F, etc. can also be represented by selective activation of segments 12*a*–12*g*. However, as noted above, failure of one of the segments to be activated in response to a control signal applied to display character 10, for example, due to an open circuit that prevents an actuating voltage from being applied to the segment, can cause an error in the character represented. Thus, a "7" can appear as a "1" if segment 12*a* fails to activate, or an "8" can appear as a "0" if segment 12*g* fails. These types of failures can have severe consequences if display character 10** is used on the display panel of medical apparatus or in other applications in which an improperly represented character causes the display to improperly represent critical information to an operator that can have grave, possibly life threatening consequences.

In the prior art, each of segments **12*a*–12*g*** is separately and independently controlled to represent a desired alphanumeric character. As a consequence, failures of certain of the segments due to interruption of the actuating voltage normally provided to a segment can cause erroneous characters to be represented without any indication to the user that a failure has occurred. However, the present invention substantially reduces the risk of such failures going undetected, by selectively controlling the segments with fore plane and back plane signals selectively connected to specific segments so as to make such failures visually evident. Details of this technique are explained below.

Figure 2:
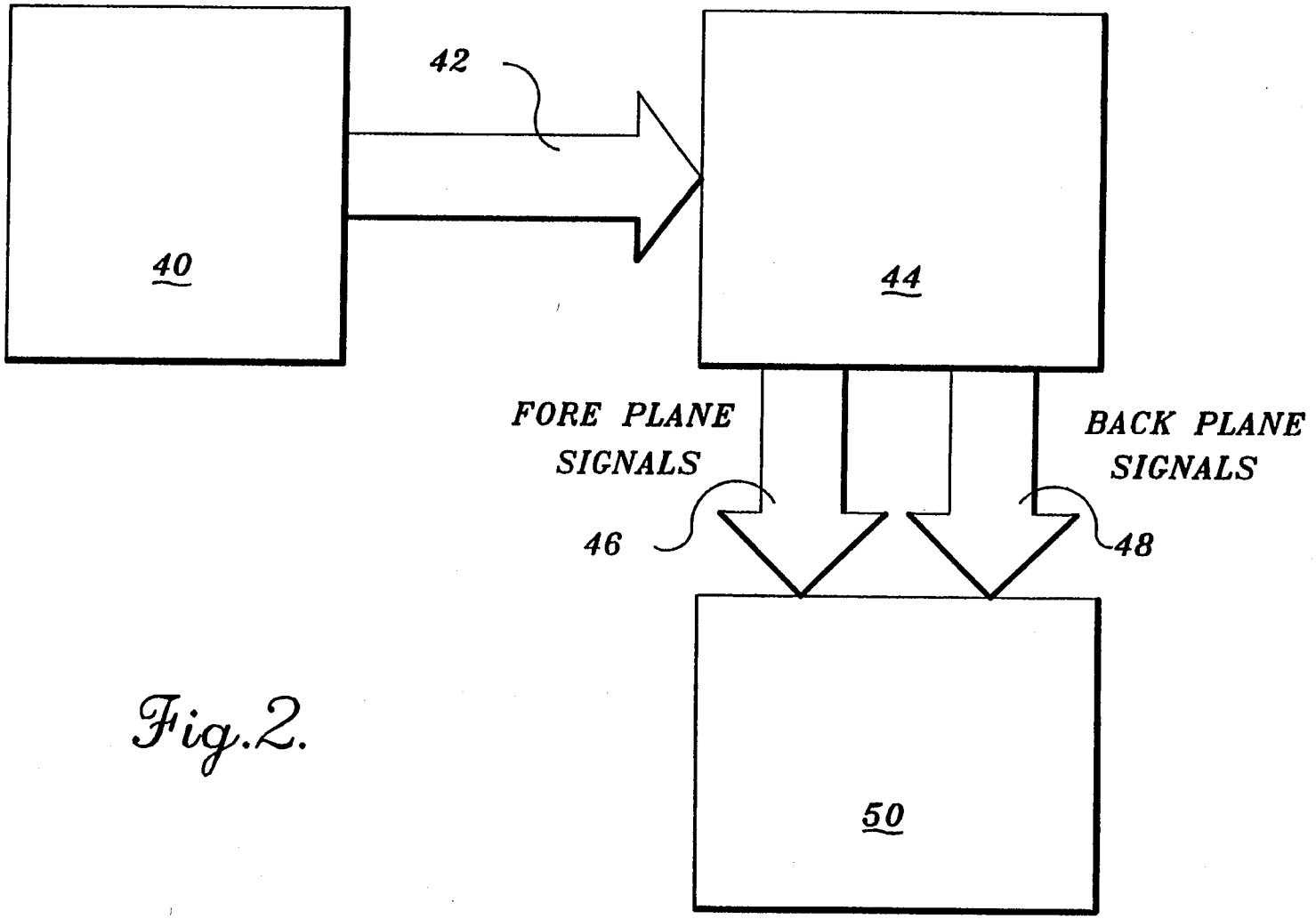
FIG. 2 is a schematic block diagram showing a display driver and other hardware components used in the present invention.

Turning now to FIG. 2, an appropriate circuit is shown for driving one or more of the display characters used in implementing the present invention. A data source 40, which may comprise a central processing unit (CPU) or the controller of an instrument produces a binary signal that is coupled through data lines 42 to a display driver 44. The binary signal conveyed on data lines 42 indicates a desired character or characters to be visually represented on a display 50. In response to the signals supplied to it, display driver 44 interprets the binary signal provided by data source 40 and produces appropriate fore plane signals and back plane signals that are conveyed to display 50 on lines 46 and 48, respectively, to cause the display to visually indicate the character(s). Display driver 44 comprises, for example, a Motorola type MC145000 Master LCD driver circuit. If more than one character is included in display 50, the additional characters can be controlled using, for example, a Motorola type MC145001 Slave LCD driver circuit for each additional character used in the display. Such display drivers or their equivalents are readily configured to provide the multiplexed fore plane and back plane signals described below.

As used herein, the term fore plane signals and back plane signals specifically refer to segment actuation voltages at levels sufficient to cause one of the segments comprising a character on display 50 to be actuated so that it changes optical characteristics and is visually perceptible. Preferably, display 50 comprises an LCD panel.

As is well known to those of ordinary skill in the art, an LCD region becomes visually perceptible when, in response to an appropriate voltage, an electric field is developed across the LCD region that causes the region to darken, in contrast with a lighter, reflective background. Under low ambient light conditions, the background may optionally be lighted to contrast with the segments of each LCD character that are activated. The voltages required to activate specific regions corresponding to segments of character(s) in display 50 are provided by display driver 44 in a generally conventional manner. However, unlike the prior art, the fore plane and back plane signals are selectively coupled to specific segments so that failure of any one of the signals to actuate the segment or segments to which the signals are supplied becomes immediately evident because a character that is not part of the set of characters normally represented on display 50 becomes visually perceptible instead of the desired character.

Figure 4:
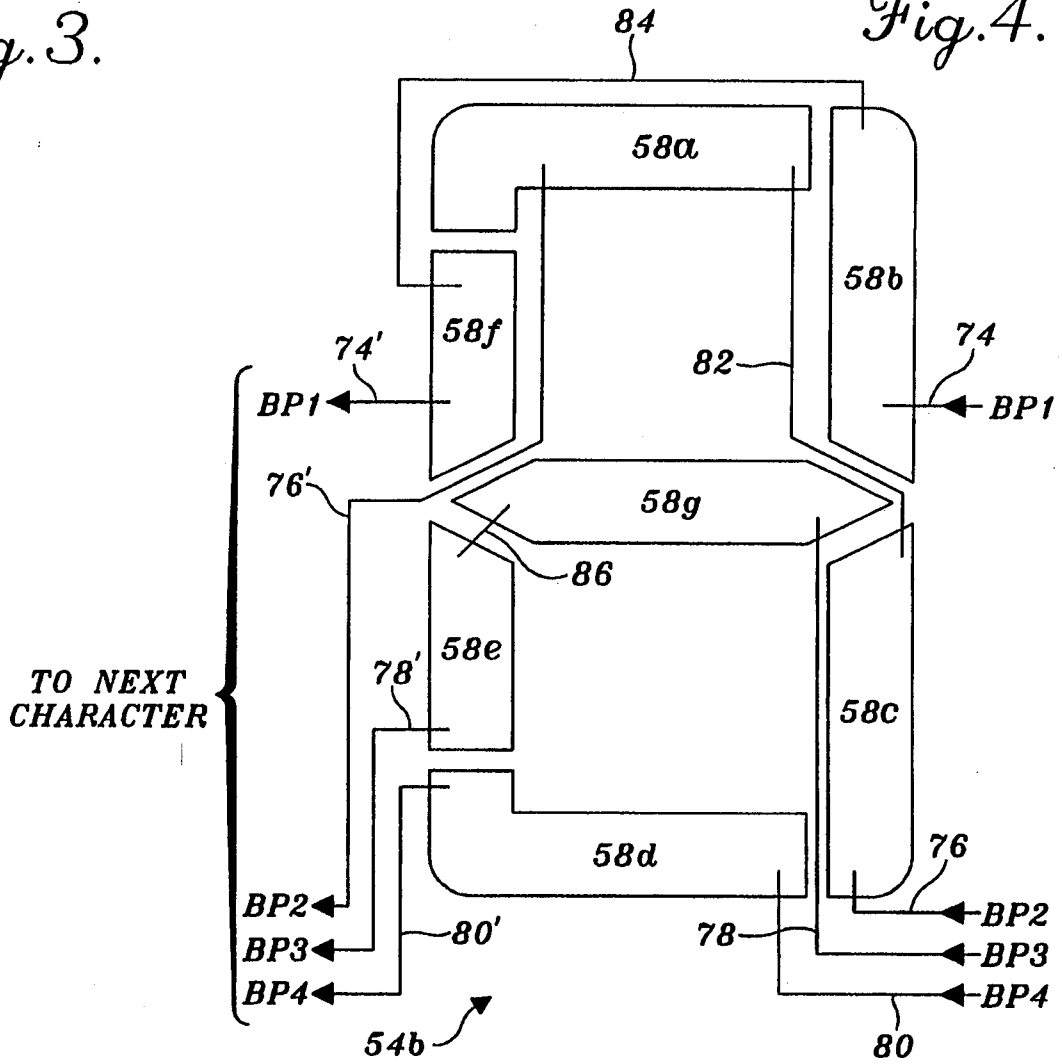
FIG. 4 is an enlarged plan view of back plane electrodes and back plane traces coupled to the back plane electrodes of the seven-segment character.
Figure 3:
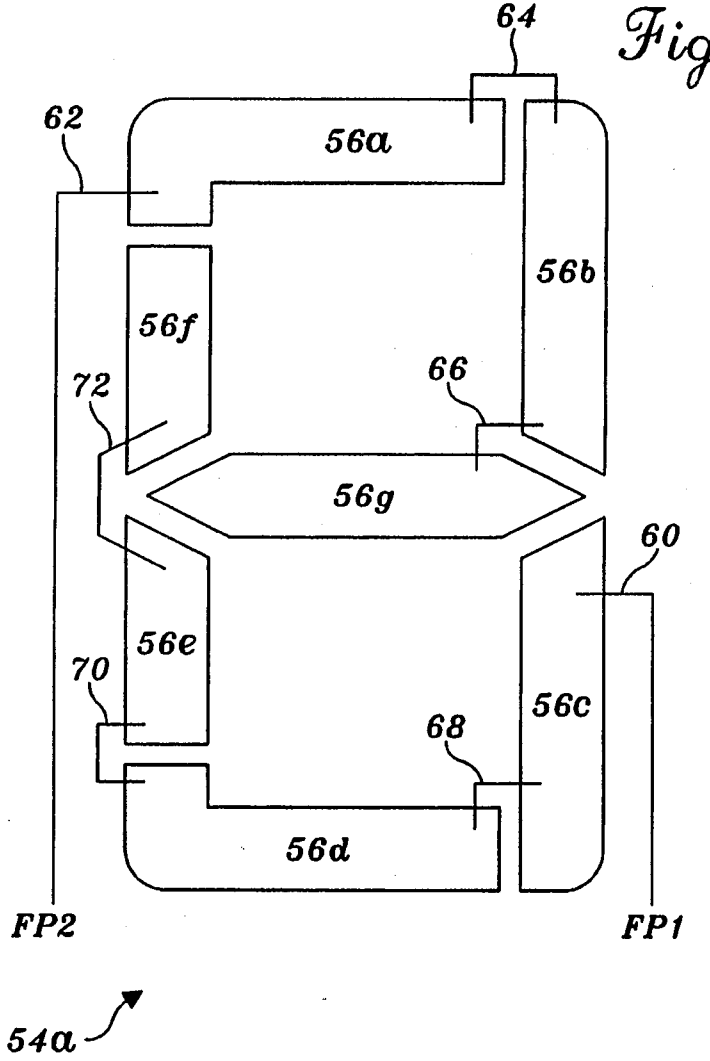
FIG. 3 is an enlarged plan view of fore plane electrodes and fore plane traces that are coupled to the fore plane electrodes of the seven-segment display character.

The interconnections between specific segments and the fore plane signals and back plane signals to produce a display character that indicates when such a failure has occurred are shown in FIGS. 3 and 4, respectively. FIG. 3 shows the fore plane electrodes **56*a*–56*g*, corresponding to the seven segments a–g of the display character in accordance with the present invention. Fore plane electrode 56*a* thus defines the shape of segment "a" corresponding to segment 12*a* in prior art display character 10 (FIG. 1), and in similar fashion, fore plane electrodes 56*b*–56*g* each defined the shape of corresponding segments "b" through "g," i.e., corresponding to segments 12*b* through 12*g* in prior art display character 10. Fore plane electrodes 56*a*–56*g* are applied proximate the front surface of a substrate (not shown) comprising display 50**.

Although the fore plane and back plane electrodes for only one character are represented in FIGS. 3 and 4, it will be understood, that each character of display 50 includes fore plane and back plane electrodes that operate in substantially the same manner. Thus, FIG. 4 shows that the back plane signals input to the illustrated display character are conveyed to another character in a plurality of characters that may comprise display 50. In the event that only a single character is required, these back plane signals would be provided only to the one character.

Referring first to FIG. 3, fore plane signals are selectively applied to a specific character **56*a* to activate selected segments of the character through traces 60 and 62, which are also applied to the substrate, proximate its front surface. A first fore plane signal FP1, conveyed through trace 60 is coupled to a fore plane electrode 56*c*, and through interconnecting traces 68, 70, and 72, this signal is also coupled to fore plane electrodes 56*d*, 56*e*, and 56*f*, respectively. Similarly, the voltage comprising the other of the fore plane signals, FP2, is conveyed to fore plane electrode 56*a* through trace 62 and is coupled by interconnecting traces 64 and 66 to fore plane electrodes 56*b* and 56*g***.

As shown in FIG. 4, traces 74, 76, 78, and 80 convey back plane signals, BP1–BP4, respectively, to corresponding selected back plane electrodes **58*a*–58*g*. These back plane electrodes are disposed proximate the rear surface of the substrate, generally underlying the corresponding fore plane electrodes 56*a*–56*g*. Consequently, when the appropriate voltage is applied between fore plane electrode 56*a* and back plane electrode 58*a***, the segment represented by the shape of the two electrodes is visually activated as the liquid crystal region disposed between the two electrodes experiences a change in optical characteristic so that it is visually perceptible.

Back plane signal BP1 conveyed over trace 74, is coupled to back plane electrode **58*b*. The same voltage is conveyed through an interconnecting trace 84 to back plane electrode 58*f*. Assuming that additional characters exist in display 50, the voltage comprising back plane signal BP1 is conveyed to the corresponding back plane electrode of the next character (not shown) through a trace 74'. Back plane signal BP2 is coupled through trace 76 to back plane electrode 58*c*, and through an interconnecting trace 82, to back plane electrode 58*a*. A trace 76' conveys back plane signal BP2 to the next character, if used. Back plane signal BP3 is conveyed through a trace 78 to back plane electrode 58*g* and then through an interconnecting trace 86, to back plane electrode 58*e*; a trace 78' conveys the signal to the next character. Finally, back plane signal BP4 is conveyed through trace 80 to back plane electrode 58*d* and is applied to the next character, if used, through a trace 80'**.

If four display characters are used in display 50, the same four back plane signals BP1–BP4 are simultaneously applied to each of the display characters, however, fore plane signals FP1 and FP2 are applied to only one character at a time. The four back plane signals are changed as appropriate to represent successive characters on the display, and the appropriate fore plane signals for the character in question are then activated. Each of the numerals preferably comprising the four digits indicated on display 50 are repetitively visually activated at a multiplexing speed sufficiently fast so that the observer sees the four digits as if each display character were continuously indicated. The persistence of the LCD regions causes the display character to be visible briefly after the voltages activating each of the segments comprising the character have been deactivated, virtually eliminating any flicker due to the time multiplexing of the display characters.

The advantage of selecting the specific fore plane electrodes 56 that are coupled to fore plane signals FP1 and FP2 and the specific back plane electrodes 58 that are coupled to the back plane signals BP1–BP4 is indicated in Table 1.

TABLE 1

| Failure | Inactivated Segments | Failure Analysis: Desired Characters vs. Indicated Characters 0 | 1 | 2 | 3 | 4 | 5 | 6 | 7 | 8 | 9 |
|---|---|---|---|---|---|---|---|---|---|---|---|
| BP1 Open | d | | | | | | | | | | |
| BP2 Open | f, b | | | | | | | | | | |
| BP3 Open | e, g | | | | | | | | | | |
| BP4 Open | a, c | | | | | | | | | | |
| FP1 Open | f, c, e, d | | | | | | | | | | |
| FP2 Open | b, a, g | | | | | | | | | | |

As shown above in Table 1, failure of any one of the four back plane signals or the two fore plane signals causes one or more specific segments to be inactive, but the resulting displayed character is either the intended display character because the affected segment(s) are not involved in visually representing the intended display character, or, the resulting displayed character is not one of the digits 0–9 that is expected to be displayed. For example, if back plane signal BP2 is open, the segments corresponding to fore plane electrodes 56*f* and 56*b* (or back plane electrodes 58*f* and 58*b*) are inactive. Segment f is used in representing numbers 3, 4, 5, 6, 8, and 9; and segment b is used in representing numbers 1, 2, 4, 7, 8, and 9. With both segments f and b inactive, however, the resulting visually perceptible character is not any number in the set of numbers from 0 through 9, inclusive. The same type of failure analysis is applied to each of the other back plane and fore plane signals that can be open.

Thus, by carefully selecting the segments energized by specific ones of the fore plane and back plane signals, display 50 has been made incapable of representing an incorrect number from the set of ten numeric display characters expected to be displayed thereon. Consequently, an operator seeing a character that is not among the expected set of numeric characters 0 through 9 is alerted that one or more of the segments has failed due to an open back plane or fore plane trace or some other failure that has interrupted the fore plane or back plane signal for the display character. Note however, that, for example, if signal BP1 is open so that segment d is inactive, the digits 1, 4, 7, and 9 are still properly displayed, because segment d is not used in visually representing these display characters.

Another type of failure that can occur may leave a segment continually energized. The present invention will not necessarily warn of such a failure unless the segment that is continuously energized appears in a position where it does not visually represent a segment of one of the characters in the set of characters normally expected to be displayed when other segments are energized. In order to handle a failure of the type in which a segment is always active, the method used in the above-referenced copending application in which redundant pairs of segments are employed can be used, in conjunction with the present technique. By combining the present invention with display characters in which at least some of the segments are redundant, it is possible to provide both a visual indication that one segment has failed and to still indicate the intended display character.

Figure 5:
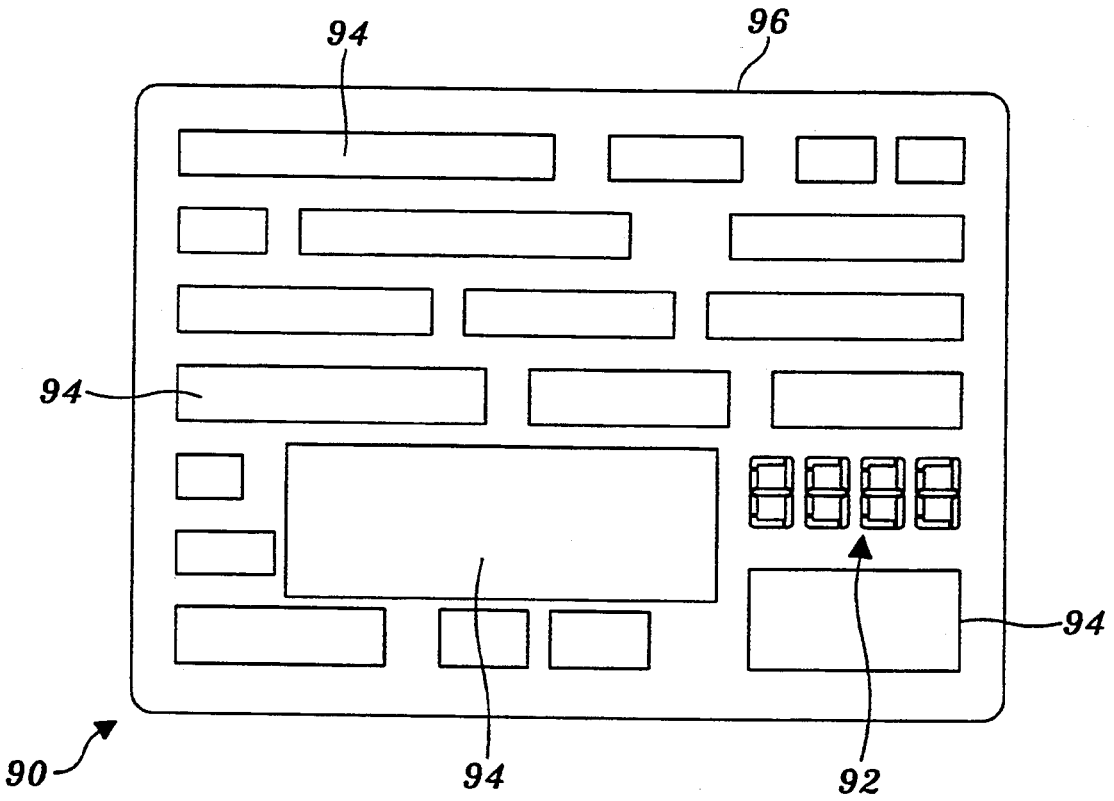
FIG. 5 is a LCD panel in which the present invention is used for multiple characters that indicate critical information on a portion of the display panel.

One advantage of the present invention is that it requires relatively few traces to convey the fore plane and back plane signals of the display. For example, as shown in FIG. 5, a relatively complex LCD panel 90 comprising a substrate 96 includes four digits 92 having segments coupled to fore plane and back plane signals in accordance with the present invention. For purposes of simplifying the figure, edge connect terminals, fore plane and back plane traces, and fore plane and back plane electrodes are not discretely shown in FIG. 5; however, given the above disclosure and FIGS. 3 and 4, these details should be evident to those of ordinary skill in the art.

Four digits 92 on LCD panel 90 are used to display information that is relatively critical in nature and should not be misread. In addition, LCD panel 90 includes a plurality of additional alphanumeric and graphic display areas 94 on which information that is less critical is indicated. Thus, four digits 92 are combined with more conventional LCD character and graphic information in an integrated manner.

While the present invention has been disclosed in connection with the preferred embodiment in which the display is implemented using LCDs, those of ordinary skill in the art will appreciate that it can also be implemented using other display technologies, such as LEDs. It should be emphasized that the present invention is also usable with displays having more or less than seven segments for each character, to provide visual evidence that a segment has not been properly activated due to a failure. By selectively distributing the control signals between seven or more segments of a display, failures that occur because of an open circuit in the control signals for the selected segments become apparent when the character visually indicated is not one of the characters in a predefined set of characters, e.g., not one of the numbers in the set of numbers from 0–9 or not one of the alpha characters in the set of letters A–Z. The same approach can thus be extended to sets of other display characters so that a failure of the control signals supplied to actuate a segment becomes immediately evident when the indicated character does not match any of those in the selected set of characters. These and other modifications to the preferred embodiment disclosed above will be apparent to those of ordinary skill in the art. Accordingly, it is not intended that the present invention in any way be limited by the disclosure, but instead that its scope be determined by reference to the claims that follow.

The embodiments of the invention in which an exclusive property or privilege is claimed are defined as follows:

1. A display circuit comprising:

(a) a substrate on which is defined a circuit comprising a plurality of conducting traces;

(b) a plurality of segments electrically coupled to the plurality of conducting traces and configured in a predefined pattern on the substrate, said pattern being capable of visually representing a character from a set of predefined characters, specific segments being electrically coupled to selected ones of the plurality of conducting traces, said conducting traces thus coupled being selected so that a failure of any one of the conducting traces to electrically actuate a single segment to which it is electrically coupled in response to an externally supplied electrical signal that should have actuated the segment, does not cause a different character of the set of predefined characters to be visually represented by the display circuit than would have been, absent the failure.

2. The display circuit of claim 1, further comprising display control means that respond to the externally supplied electrical signal to provide an actuating voltage to specific segments that must be actuated to visually represent a selected character.

3. The display circuit of claim 1, wherein a fore plane electrode and a back plane electrode define a visually perceived shape of each segment, an actuating voltage applied between the fore plane and back plane electrodes activating a liquid crystal region disposed between the fore plane electrode and the back plane electrode to change an optical property of the liquid crystal region so that the segment is visually perceptible unless a failure has occurred.

4. The display circuit of claim 3, wherein the plurality of conducting traces comprises a set of fore plane traces and a set of back plane traces, and wherein the actuating voltage applied to activate the liquid crystal region for each segment is coupled to one of the fore plane electrodes through one of the fore plane traces and to one of the back plane electrodes through one of the back plane traces.

5. The display circuit of claim 4, wherein one of the sets of fore plane traces comprises two conducting traces, and the other set comprises four conducting traces.

6. The display circuit of claim 1, wherein the segments are configured to visually represent a number eight when all segments are visually perceptible.

7. The display circuit of claim 1, wherein the set of predefined characters includes at least numbers zero through nine.

8. The display circuit of claim 1, wherein the substrate includes areas in which a plurality of characters are defined and are visually perceptible when selected segments are actuated.

9. A display circuit, comprising:

(a) a substrate having at least two layers, including a back plane and fore plane, and a circuit comprising conducting traces formed on the back plane and the fore plane;

(b) a liquid crystal layer disposed between said at least two layers of the substrate, visually perceptible properties of portions of the liquid crystal layer changing in response to an electrical field applied across the liquid crystal layer to visually represent a selected alphanumeric character from a predefined set of alphanumeric characters as a plurality of segments; and (c) a plurality of electrically conductive electrodes applied to the substrate that are electrically coupled to the conducting traces, the electrical field being developed between selected ones of the electrically conductive electrodes in response to a voltage being applied thereto through the conducting traces, the conducting traces coupled to specific electrically conductive electrodes being selected so that a failure of any one of the conducting traces does not cause a different alphanumeric character of the set of alphanumeric characters to be visually represented than would have been, absent the failure.

10. The display circuit of claim 9, further comprising control means, coupled through the conducting traces to the electrically conductive regions, for controlling the application of the voltage to the electrically conductive electrodes to cause selected segments to be visually perceptible to represent a desired alphanumeric character.

11. The display circuit of claim 9, wherein the electrically conductive traces comprise a plurality of fore plane traces and a plurality of back plane traces, each segment becoming visually perceptible in response to the voltage applied to the electrically conductive regions through only one of the fore plane traces and only one of the back plane traces.

12. The display circuit of claim 9, wherein the alphanumeric character comprises at most seven segments.

13. The display circuit of claim 9, wherein only a subset of all possible alphanumeric characters can be displayed by the display circuit, failure of any segment to be visually perceptible when activated by the voltage applied to the electrically conductive regions producing a visually perceptible displayed character that is not in said subset of alphanumeric characters, thereby providing an indication that a failure has occurred.

14. A display circuit, comprising:

(a) segment means for visually indicating a desired character from a set of alphanumeric characters, the desired character being activated by an applied voltage;

(b) control means, coupled to the segment means, for supplying a voltage to the segment means to cause a character to be visually perceptible; and (c) means for indicating that a failure has occurred in supplying the voltage to the segment means by at times, causing a character to be visually perceptible that is not in the set of alphanumeric characters and is not the desired character.

15. The display circuit of claim 14, wherein the segment means comprise a plurality of regions that become visually perceptible in response to the voltage applied.

16. The display circuit of claim 15, wherein the means for indicating that a failure has occurred comprise means for supplying the voltage to activate only selected regions, so that if the means for supplying fail, any one region that should be visually perceptible and is not causes the character that is visually represented as a result of the failure to differ from any in the set of alphanumeric characters.

17. The display circuit of claim 14, wherein the segment means comprise a plurality of liquid crystal display regions that are activated by the voltage applied.

18. The display circuit of claim 17, wherein the means for indicating that a failure has occurred comprise a plurality of conductors, and specific ones of the plurality of conductors are selected to activate specific liquid crystal display regions with the voltage, so that if any one liquid crystal region should be visually perceptible in response to the applied voltage and is not, the character that is visually represented as a result of the failure differs from any in the set of alphanumeric characters.

19. The display circuit of claim 14, wherein the segment means include at least seven segment that can be made visually perceptible.

20. The display circuit of claim 14, wherein the set of alphanumeric characters include the numerals from zero through nine.

* * * * *